US007870649B2

(12) United States Patent
Mikuma et al.

(10) Patent No.: US 7,870,649 B2
(45) Date of Patent: Jan. 18, 2011

(54) WATERPROOF SLIDE FASTENER

(75) Inventors: Ryo Mikuma, Toyama-ken (JP); Masahiro Kusayama, Toyama-ken (JP)

(73) Assignee: YKK Corporation, Tokyo (JP)

( * ) Notice: Subject to any disclaimer, the term of this patent is extended or adjusted under 35 U.S.C. 154(b) by 785 days.

(21) Appl. No.: 11/607,628

(22) Filed: Dec. 1, 2006

(65) Prior Publication Data

US 2007/0137006 A1 Jun. 21, 2007

(30) Foreign Application Priority Data

Dec. 20, 2005 (JP) ..... 2005-366873

(51) Int. Cl.
*A44B 19/02* (2006.01)

(52) U.S. Cl. ..... 24/413; 24/403; 24/405; 24/432

(58) Field of Classification Search ..... 24/403, 24/405, 413, 384, 432, 389
See application file for complete search history.

(56) References Cited

U.S. PATENT DOCUMENTS

| | | | | |
|---|---|---|---|---|
| 4,495,679 | A * | 1/1985 | Scarpini | 24/414 |
| 4,502,190 | A * | 3/1985 | Inamura | 24/389 |
| 4,765,038 | A * | 8/1988 | Kasai | 24/389 |
| 7,337,506 | B2 * | 3/2008 | Kusayama et al. | 24/389 |
| 7,416,397 | B2 * | 8/2008 | Kusayama et al. | 425/116 |
| 7,500,291 | B2 * | 3/2009 | Matsumoto | 24/389 |
| 2006/0207069 | A1 * | 9/2006 | Cheng | 24/389 |
| 2006/0236510 | A1 * | 10/2006 | Kusayama et al. | 24/436 |
| 2007/0226966 | A1 * | 10/2007 | Tominaga | 24/389 |

FOREIGN PATENT DOCUMENTS

| | | |
|---|---|---|
| EP | 1 568 290 | 8/2005 |
| GB | 2 085 518 | 4/1982 |
| JP | 59-42893 | 12/1984 |
| JP | 2005-237577 | 9/2005 |
| WO | WO 02/03825 | 1/2002 |

* cited by examiner

*Primary Examiner*—Robert J Sandy
*Assistant Examiner*—Michael Lee
(74) *Attorney, Agent, or Firm*—Alston & Bird LLP

(57) ABSTRACT

A waterproof slide fastener in which an entire surface of a fastener tape is covered with elastomer, through holes are made in a side edge of the fastener tape, and fastener elements each comprising a coupling head, a neck portion, an engaging projection, a leg portion and a tongue piece, are molded by injection molding so as to cover the through holes. Reinforcing portions are provided projectingly from sides of the leg portion so as to cover at least a part of each of the through holes in a longitudinal direction of the through holes made in the fastener tape so that the reinforcing portions surround the through holes, so the reinforcing portions prevent the through holes from being exposed even when the fastener tape is bent, thereby maintaining water-tightness and airtightness.

2 Claims, 16 Drawing Sheets

WATERPROOF SLIDE FASTENER

BACKGROUND OF THE INVENTION

1. Field of the Invention

The present invention relates to a waterproof slide fastener having waterproof property in which the entire front and rear surfaces of a woven or knitted fastener tape are covered with elastomer to complete a fastener tape having waterproof property, and then, fastener elements are injection molded on side edges of the fastener tapes by using thermoplastic resin.

2. Description of the Related Art

Conventionally, according to Japanese Utility Model Publication No. 59-42893, there has been known a slide fastener formed into a configuration which prevents its fastener chain 101 from being broken, the fastener chain 101 being formed by attaching injection molded type fastener elements 103 to a fastener tape 102, as shown in FIG. 15. In this slide fastener, a core thread 140 is attached to a side edge of the fastener tape 102, and through holes 108 going through between front and rear surfaces are provided on which the fastener elements 103 are attached. The part of leg portions 114 of the fastener element 103 and a tongue piece extending from the rear end of the leg portion 114 are attached to the through hole 108 such that the through hole 108 is covered therewith. In addition, the side face of the tongue piece provided on the end portion of the leg portion 114 is provided with a bend restricting piece 130 in a state in which it keeps contact with the fastener tape 102 with a larger width than that of the leg portion 114 in order to prevent the chain from being cracked when the fastener chain 101 is bent in the longitudinal direction.

Additionally, according to Japanese Patent Laid-Open Publication No. 2005-237577, there has been known another slide fastener having waterproof property as shown in FIG. 16. In this slide fastener, both front and rear surfaces of a woven or knitted fastener tape 202 are covered with thermoplastic elastomer to complete a fastener tape 202 having waterproof property. Through holes 208 going through between front and rear surfaces are provided at each fastener element attachment position on the edge portion of the fastener tape 202. Fastener elements 203 each formed of a coupling head 210, a neck portion 212, a leg portion 214 and a tongue piece 216 are attached to the side edge of the fastener tape 202 by injection molding using thermoplastic resin. The through holes 208 are covered with the leg portions 214 of the fastener elements 203, and the leg portions 214 on the front and rear surfaces are joined by a connecting portion 215 through the through hole 208.

The slide fastener shown in FIG. 15 is an ordinary type slide fastener having no water-tightness or airtightness. In order to attach fastener elements 103 firmly to the side edge of the fastener tape 102 by injection molding using thermoplastic resin, a core thread 140 is attached to the side edge of the fastener tape 102, through holes 108 are made in the side edge of the fastener tape 102, and fastener elements 103 are molded at positions in which the through holes 108 exist. In order to prevent the fastener chain 101 from being broken, bend restricting pieces 130 having larger width than that of the leg portion 114 and projecting to the side are molded on the tongue piece formed at the rear end of the leg portion 114 of the fastener element 103 such that the bend restricting pieces 130 are joined to the fastener tape 102. As a result, when the fastener chain 101 is bent in the longitudinal direction, the bend restricting pieces 130 keep firm contact with each other, so that a large load is applied to the bend restricting pieces 130 joined to the fastener tape 102. Consequently, the fastener elements 103 turn unstable, thereby getting loose.

In the waterproof slide fastener shown in FIG. 16, the front and rear surfaces of the fastener tape 202 are covered with thermoplastic elastomer to complete a fastener tape 202 having waterproof property, through holes 208 going through between the front and rear surfaces are provided in the side edge of the fastener tape 202, and the through holes 208 are covered with the leg portions 214 of the fastener elements 203. When a load is applied in the longitudinal direction of the fastener chain, the through holes 208 are exposed out of the fastener elements 203, thereby making it difficult to maintain water-tightness. Particularly, when the size of the fastener element 203 is reduced, the through hole 208 cannot be reduced in diameter easily. The present invention is achieved by improving this point.

SUMMARY OF THE INVENTION

The present invention has been accomplished in views of the above problems, and an object of the invention is to provide a waterproof slide fastener having water-tightness and airtightness, in which a fastener tape is finished to have waterproof property by performing simple waterproof treatment on a fastener tape, through holes are made in the side edge of the fastener tape, fastener elements are formed by injection molding at positions in which the through holes are provided by using thermoplastic resin so as to cover the through holes with the leg portions of the fastener elements while intensifying and reinforcing the side face of the leg portion, so that even when a load is applied to the fastener tape, the through holes are not exposed out of the fastener elements, thereby maintaining water-tightness and airtightness for a long term.

Another object of the invention is to provide a waterproof slide fastener capable of maintaining water-tightness and airtightness securely by specifying the configuration of the reinforcing portion to be formed on the side face of the leg portion of the fastener element which covers the through hole provided in the fastener tape having waterproof property.

In order to achieve the above object, there is provided a waterproof slide fastener, being characterized in that an entire surface of a fastener tape is covered with elastomer; through holes are made in the fastener tape; fastener elements are integrally molded on front and rear surfaces of the fastener tape using thermoplastic resin such that each of the fastener elements comprises a coupling head having a coupling concave portion provided at a front end of the fastener element, a constricted neck portion, an engaging projection at a neck portion, a leg portion, and a tongue piece projecting from a rear end of the leg portion; a tape edge portion is exposed on a foreside of the engaging projection; and the leg portions are attached to the through holes, the fastener element further comprising reinforcing portions integrally formed therewith and projecting from sides of the leg portion.

Consequently, resin made fastener elements can be attached firmly to the fastener tape having waterproof property through the through holes made in the tape. Further, the through holes are never exposed by the reinforcing portions formed on the side faces of the fastener element even when a load is applied to the fastener tape, thereby not damaging the water-tightness and airtightness. As a result, it is possible to obtain a waterproof slide fastener having an excellent water stopping effect and capable of maintaining the water-tightness and airtightness for a long term.

Preferably, the reinforcing portions projecting from the sides of the leg portion are formed so as to cover at least a part of each of the through holes in a longitudinal direction of the through holes made in the fastener tape.

Consequently, the through holes made in the fastener tape are surrounded by the reinforcing portion and never exposed out of the fastener element, thereby maintaining water-tightness and airtightness securely.

Preferably, the reinforcing portions projecting from the sides of the leg portion are formed thicker than the engaging projection formed at the neck portion and thinner than the leg portion.

For this reason, the slide fastener of the invention can be adopted for fastener elements capable of maintaining water-tightness and airtightness regardless of the size of the fastener element.

Preferably, the reinforcing portions projecting from the sides of the leg portion are formed in a same thickness as the engaging projection and the tongue piece.

As a result, the peripheral portion of each fastener element is protected and reinforced, thereby maintaining water-tightness and airtightness.

Preferably, the reinforcing portions projecting from the sides of the leg portion are formed in a same thickness as the leg portion.

Accordingly, the slide fastener of the invention is suitable for small sized fastener elements, so that water-tightness and airtightness can be attained in a small sized fastener chain.

Preferably, the reinforcing portions projecting from the sides of the leg portion are formed in a larger width than the width of the engaging projection formed at the neck portion.

As a consequence, each fastener element can secure water-tightness and airtightness while it performs its coupling operation securely. Therefore, the effects achieved by the present invention are considerably great.

DESCRIPTION OF THE PREFERRED EMBODIMENTS

Figure 1:
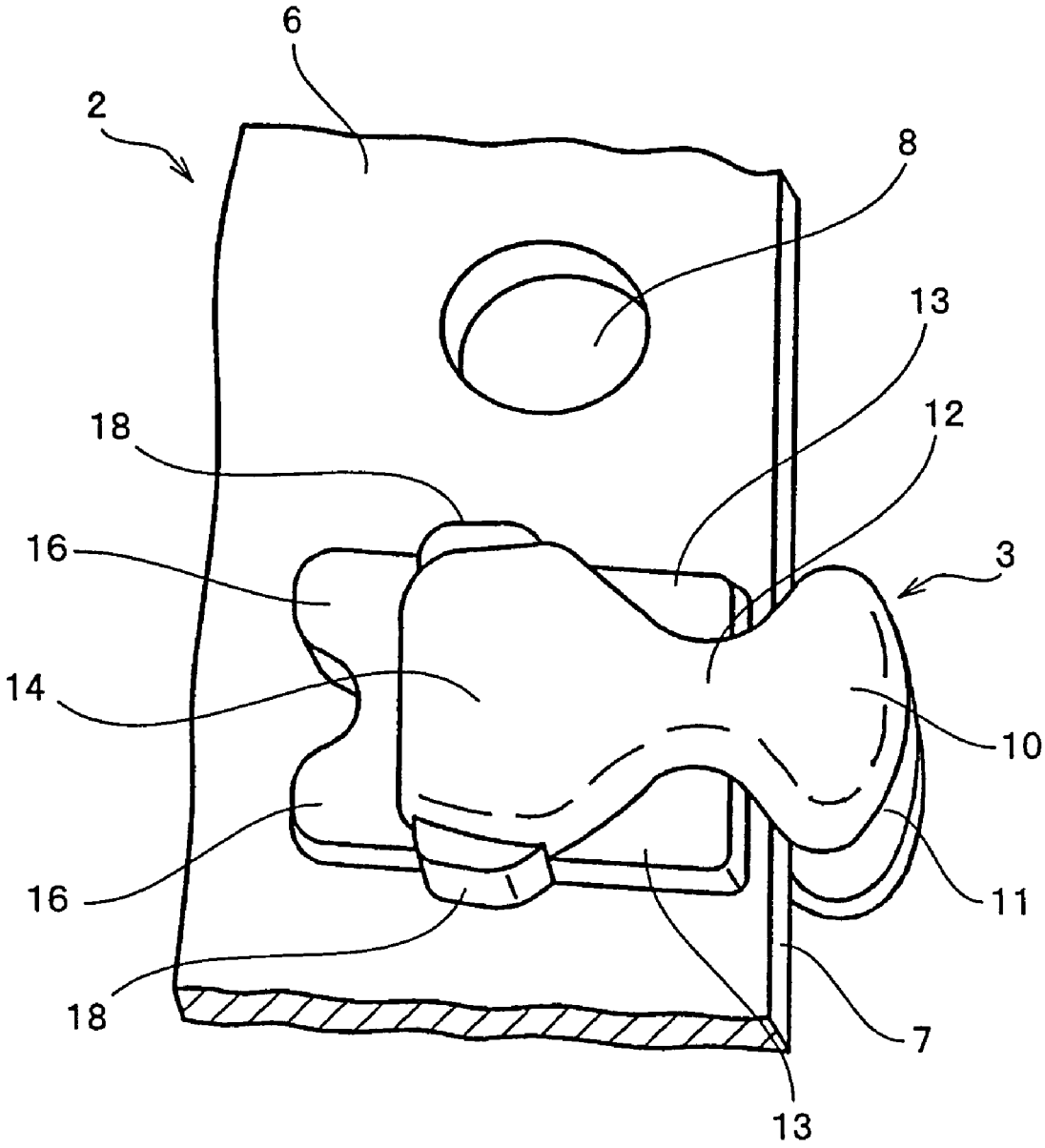
FIG. 1 is a perspective view of a fastener element of a waterproof slide fastener according to a first embodiment.

Hereinafter, preferred embodiments of the present invention will be described in detail with reference to the accompanying drawings.

A waterproof slide fastener of the present invention is configured as shown in FIGS. 1 to 5. More specifically, the waterproof slide fastener comprises a fastener tape 2 having a covering layer 6 formed therein. The covering layer 6 covers the surface of a woven or knitted base fabric 5 with elastomer such as thermoplastic elastomer or synthetic rubber. Through holes 8 going through between front and rear surfaces are provided at a constant interval, for example, at positions of the fastener tape 2 at which fastener elements 3 are to be attached by injection molding using the thermoplastic resin such that the through holes 8 are covered therewith.

In the fastener element 3, a coupling head 10 capable of engaging an engaging projection 13 of a mating fastener element is provided by providing a coupling concave portion 11 at a front end thereof, and a neck portion 12 is formed so that the neck portion 12 is constricted on the inner side of the coupling head 10. The neck portion 12 is provided with the engaging projection 13 which is fit to the coupling concave portion 11, and subsequent to the neck portion 12, a leg portion 14 equal to the engaging projection 13 in width is molded so as to cover the through hole 8 provided in the fastener tape 2. A connecting portion 15 for connecting the front and rear surfaces of the leg portions 14 is provided, and a tongue piece 16 having the same thickness as the engaging projection 13 is provided at the rear end of the leg portion 14 so that the flange of the slider can slide on the tongue piece 16.

In the waterproof slide fastener, a reinforcing portion 18 formed thicker than the engaging projection 13 and thinner than the leg portion 14 is provided integrally with the leg portion 14 facing the through hole 8 provided in the fastener tape 2 such that the reinforcing portion 18 projects from the side of the leg portion 14 more than the engaging projection 13. As a consequence, the through hole 8 formed in the fastener tape 2 is prevented from being exposed out of the fastener element 3 and prevented from being damaged in water-tightness and airtightness when a load is applied to the fastener tape 2 in the fastener chain 1.

Figure 6:
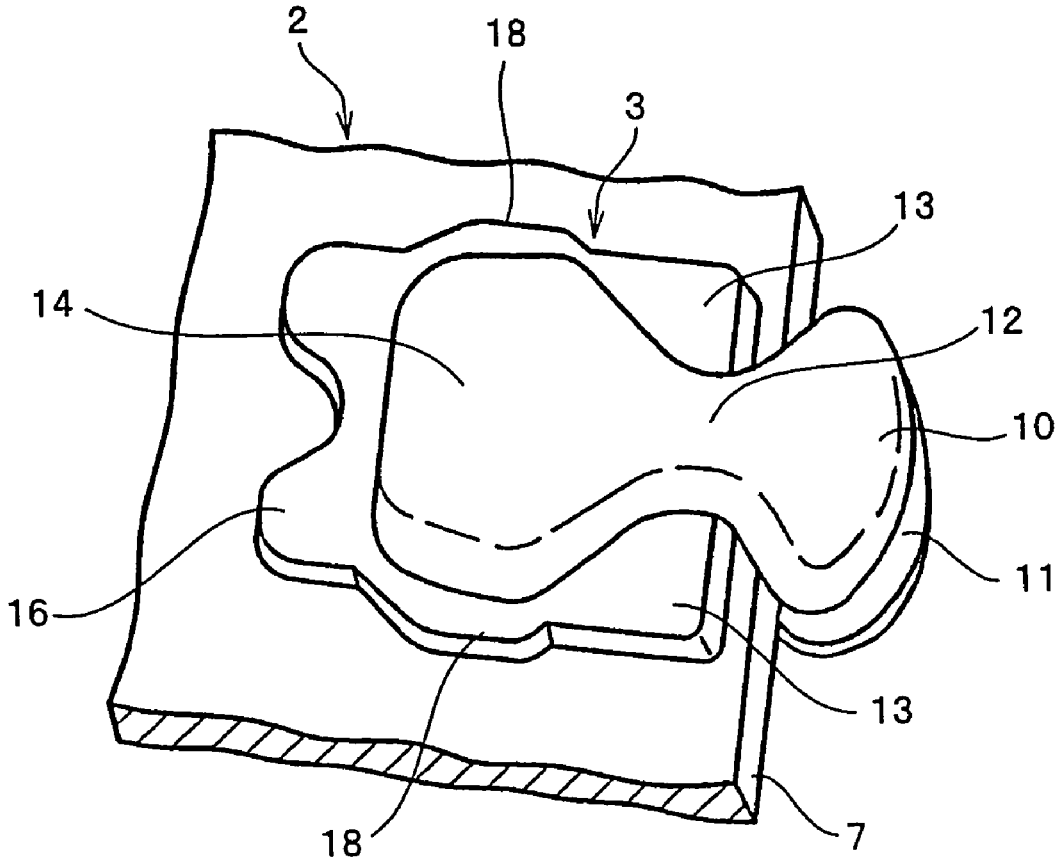
FIG. 6 is a perspective view of the fastener element of the waterproof slide fastener according to a second embodiment.
Figure 7:
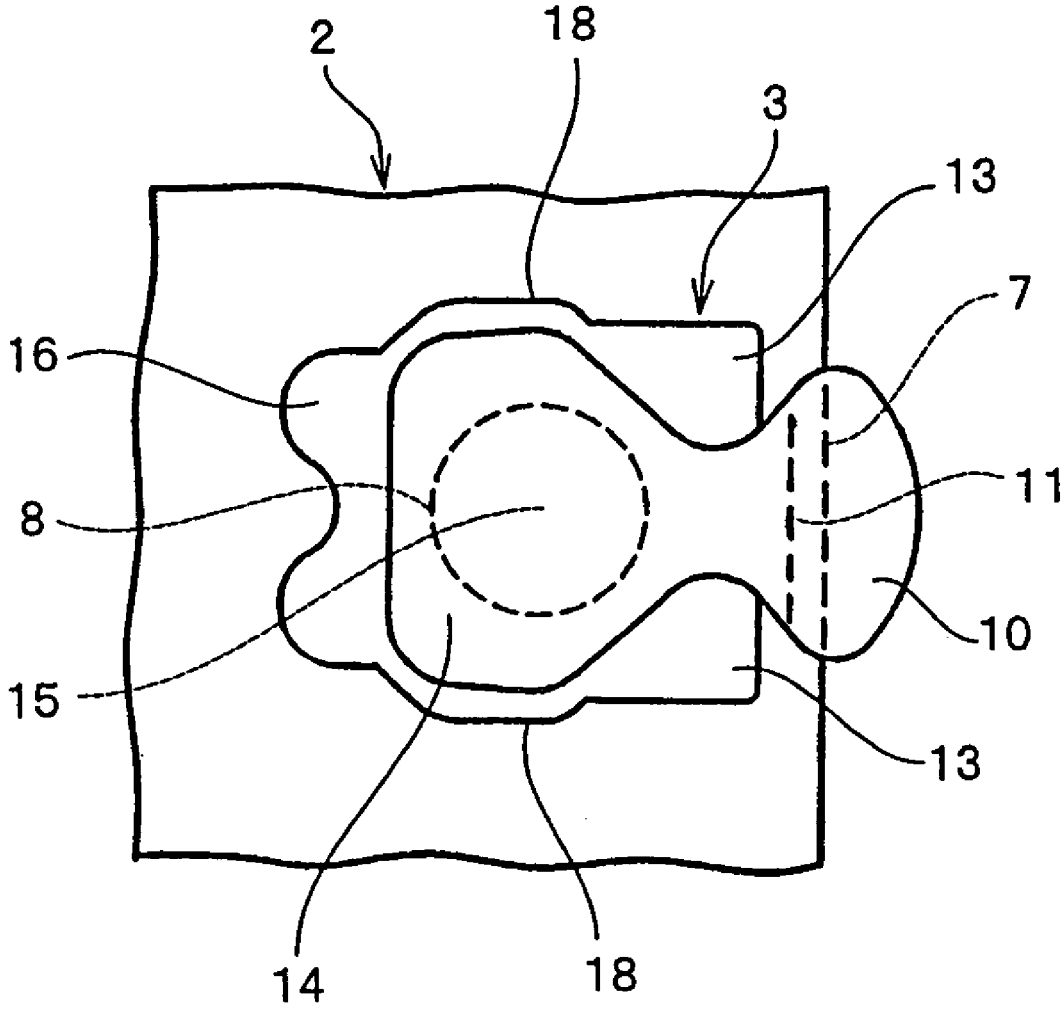
FIG. 7 is a front view of the fastener element of the waterproof slide fastener.
Figure 8:
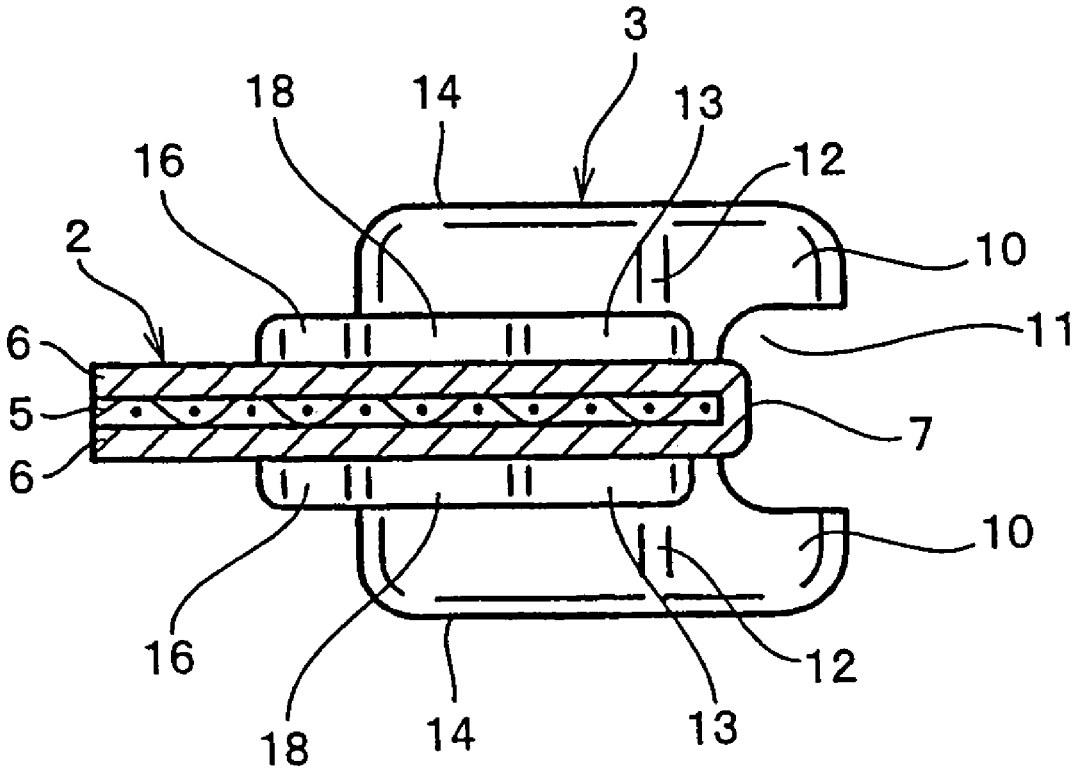
FIG. 8 is a side view of the fastener element of the waterproof slide fastener.
Figure 9:
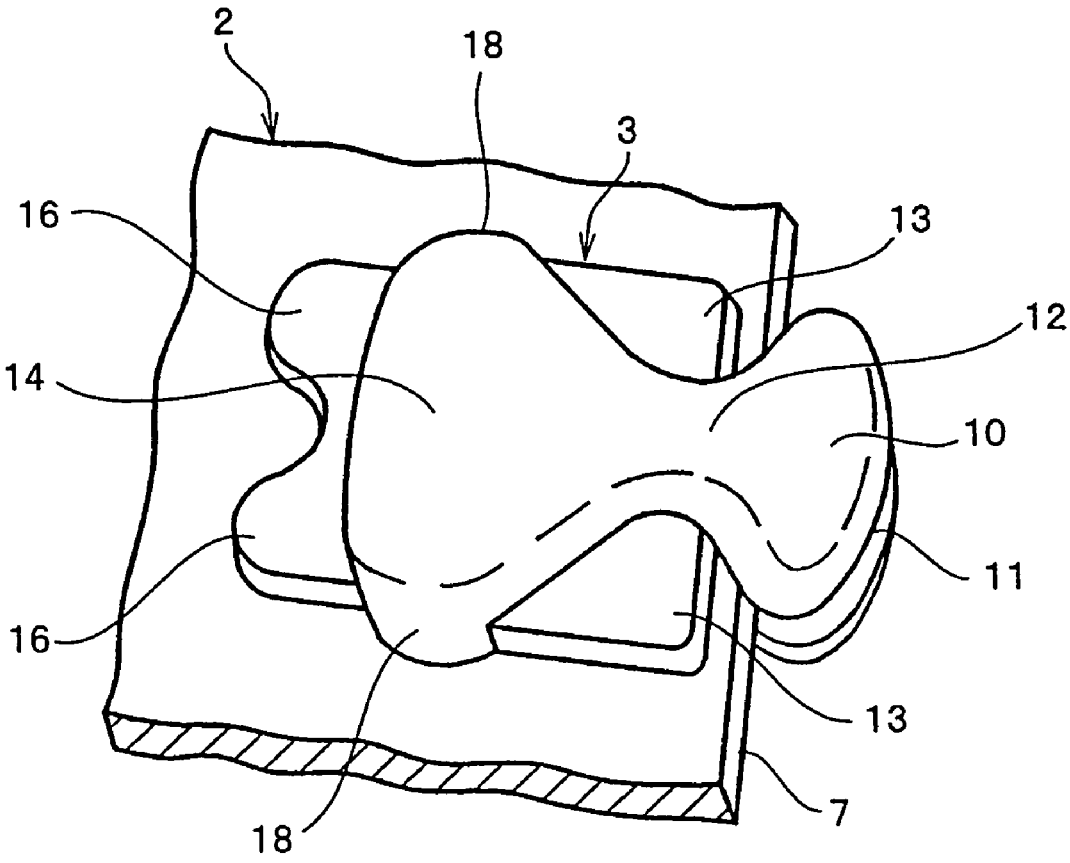
FIG. 9 is a perspective view of the fastener element of the waterproof slide fastener according to a third embodiment.
Figure 10:
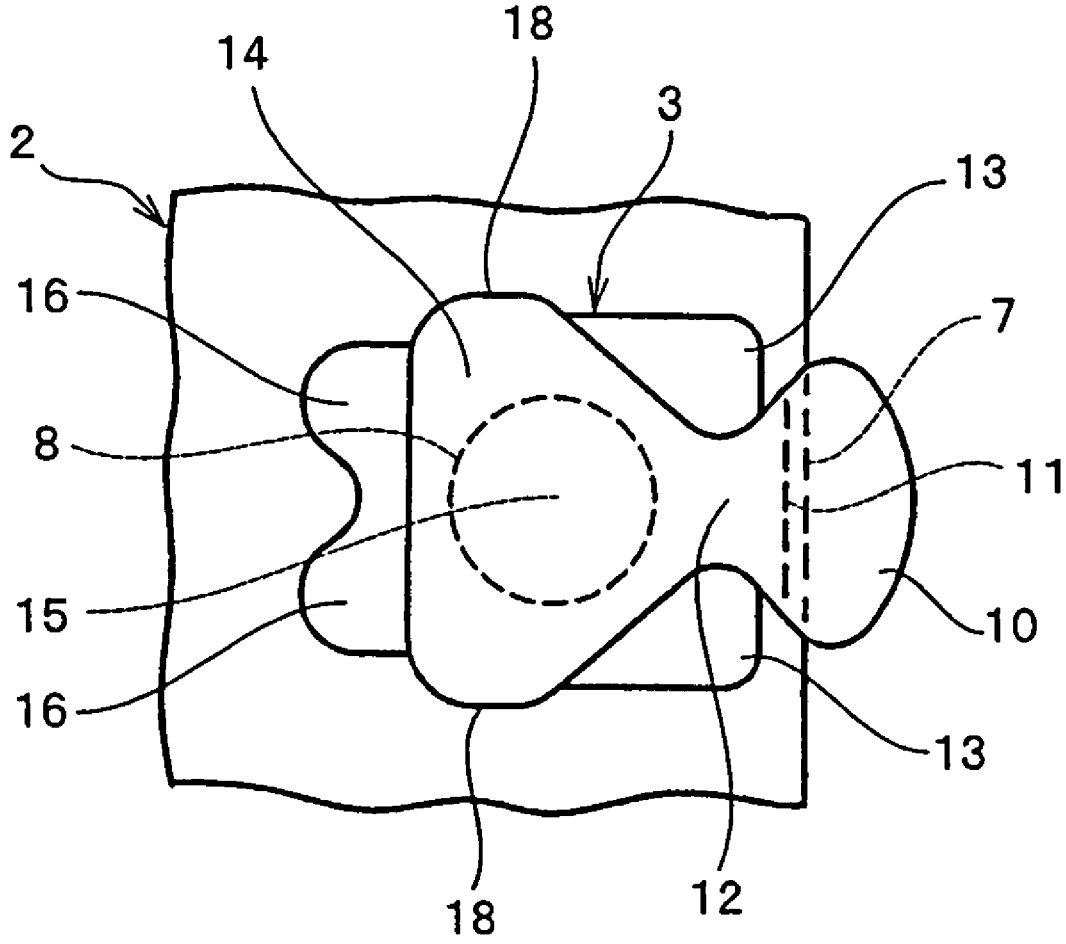
FIG. 10 is a front view of the fastener element of the waterproof slide fastener.
Figure 11:
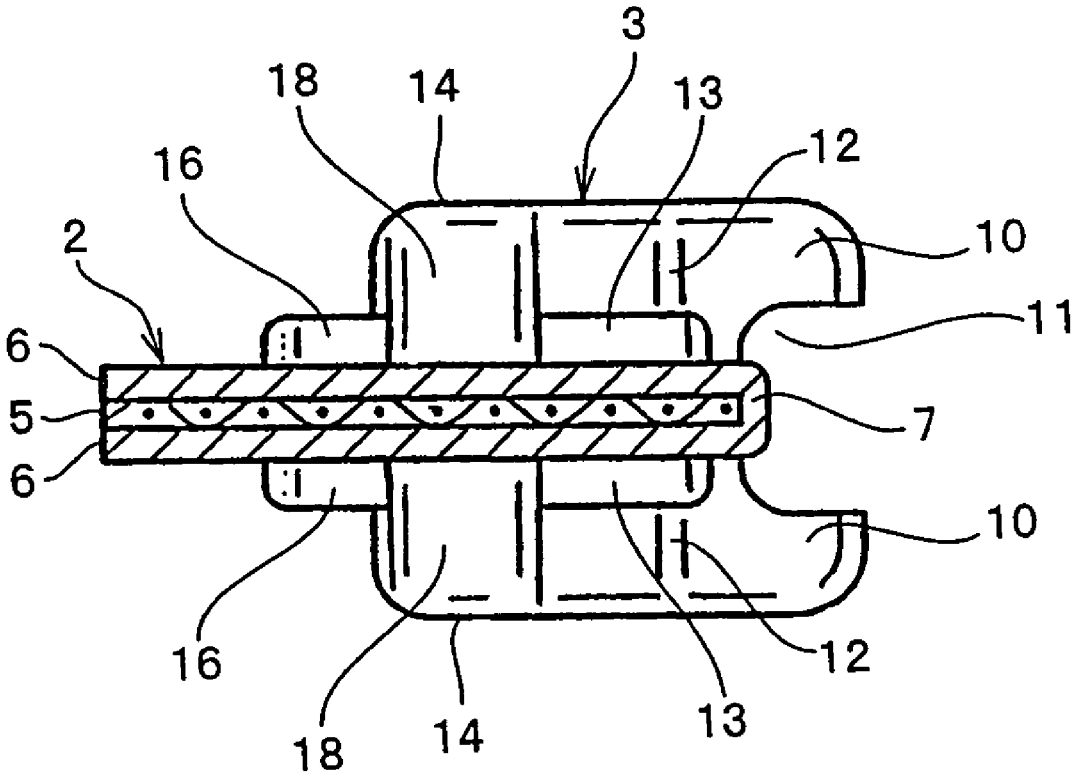
FIG. 11 is a side view of the fastener element of the waterproof slide fastener.
Figure 12:
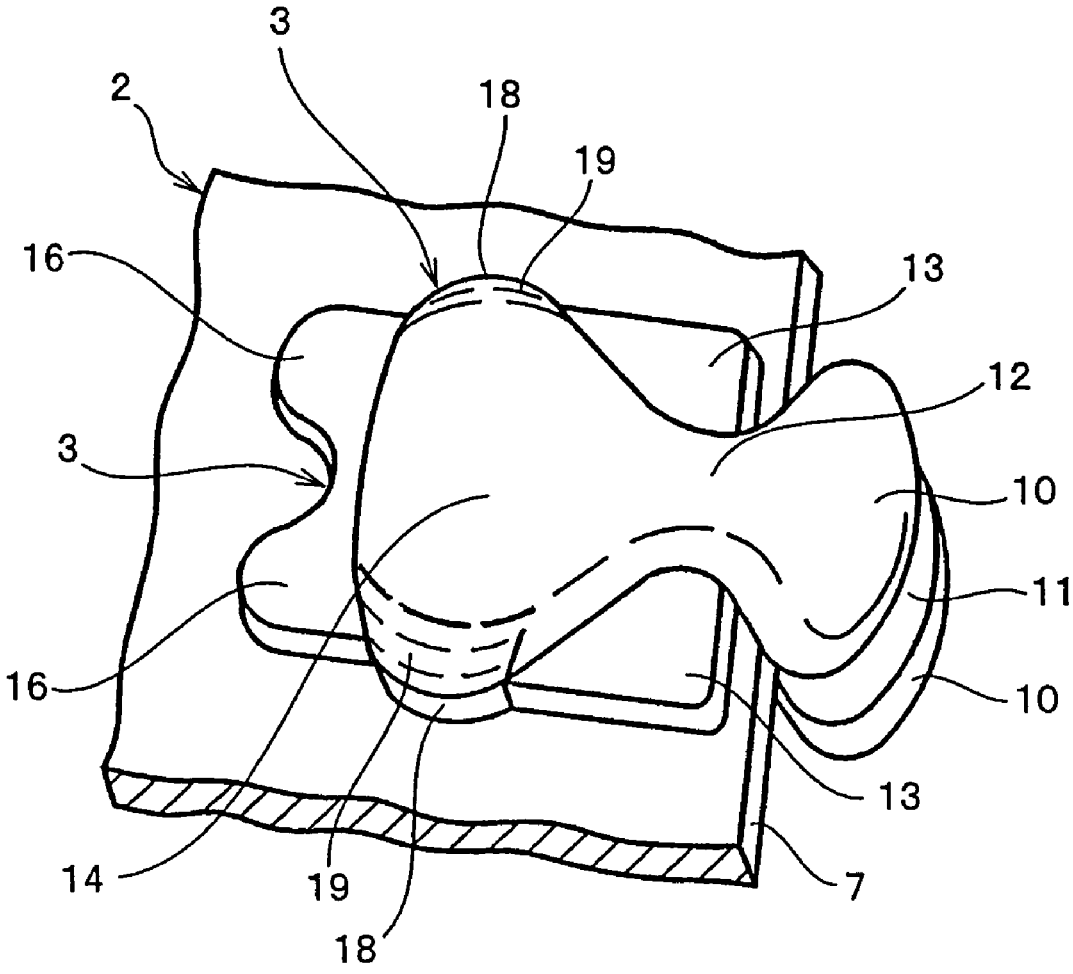
FIG. 12 is a perspective view of the fastener element of the waterproof slide fastener according to a fourth embodiment.
Figure 13:
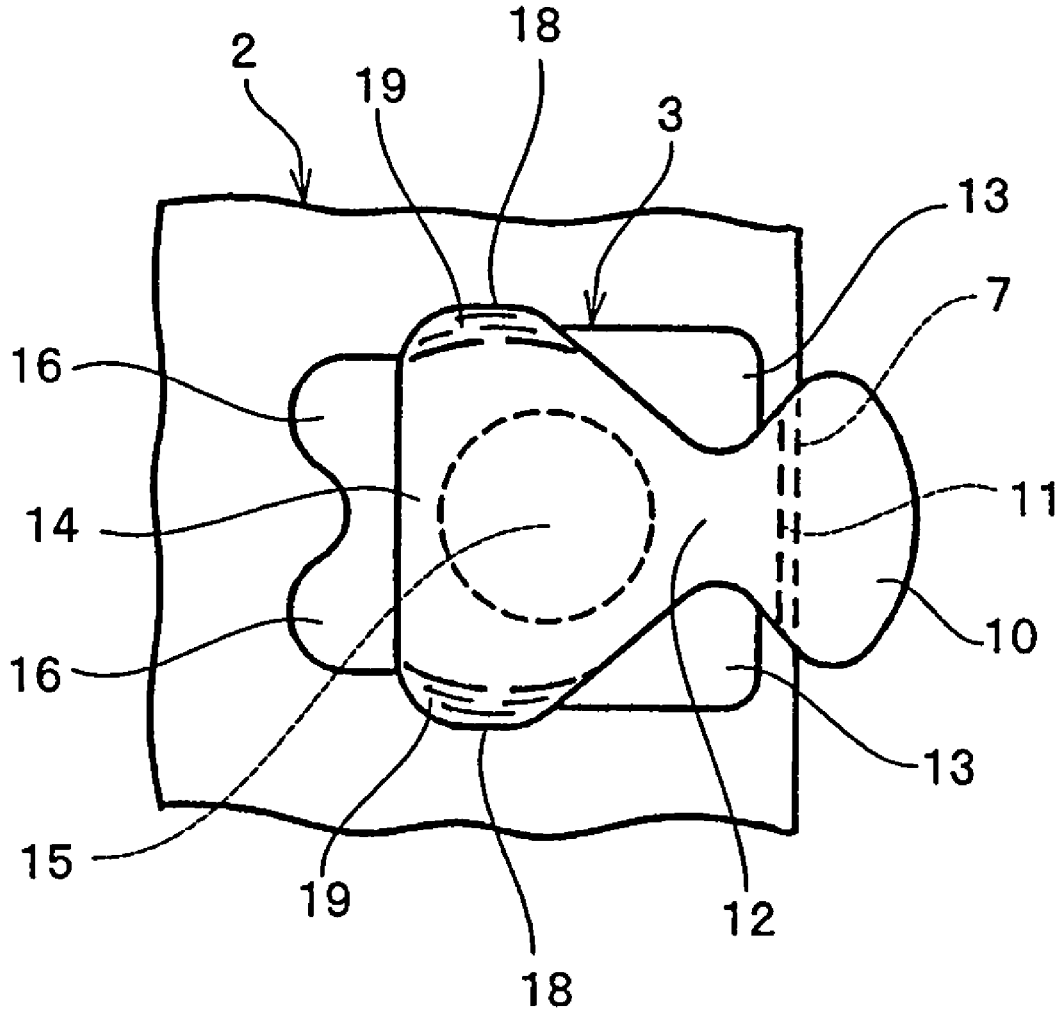
FIG. 13 is a front view of the fastener element of the waterproof slide fastener.
Figure 14:
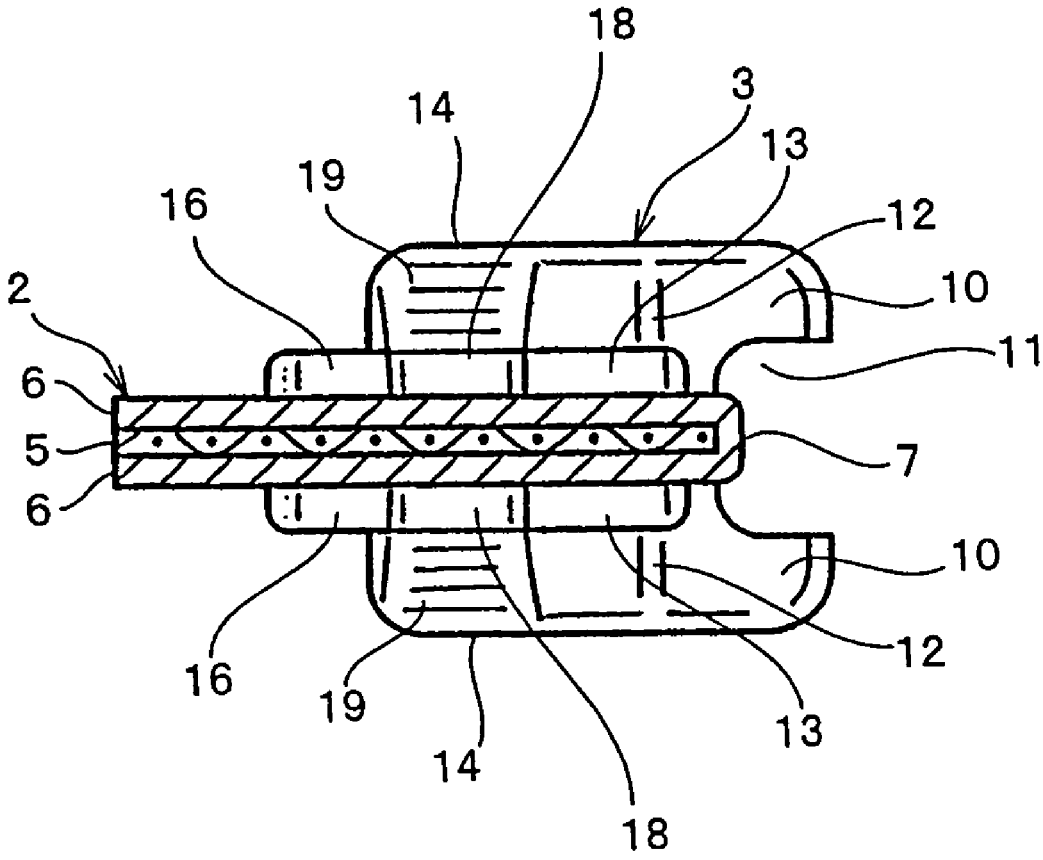
FIG. 14 is a side view of the fastener element of the waterproof slide fastener.
Figure 15:
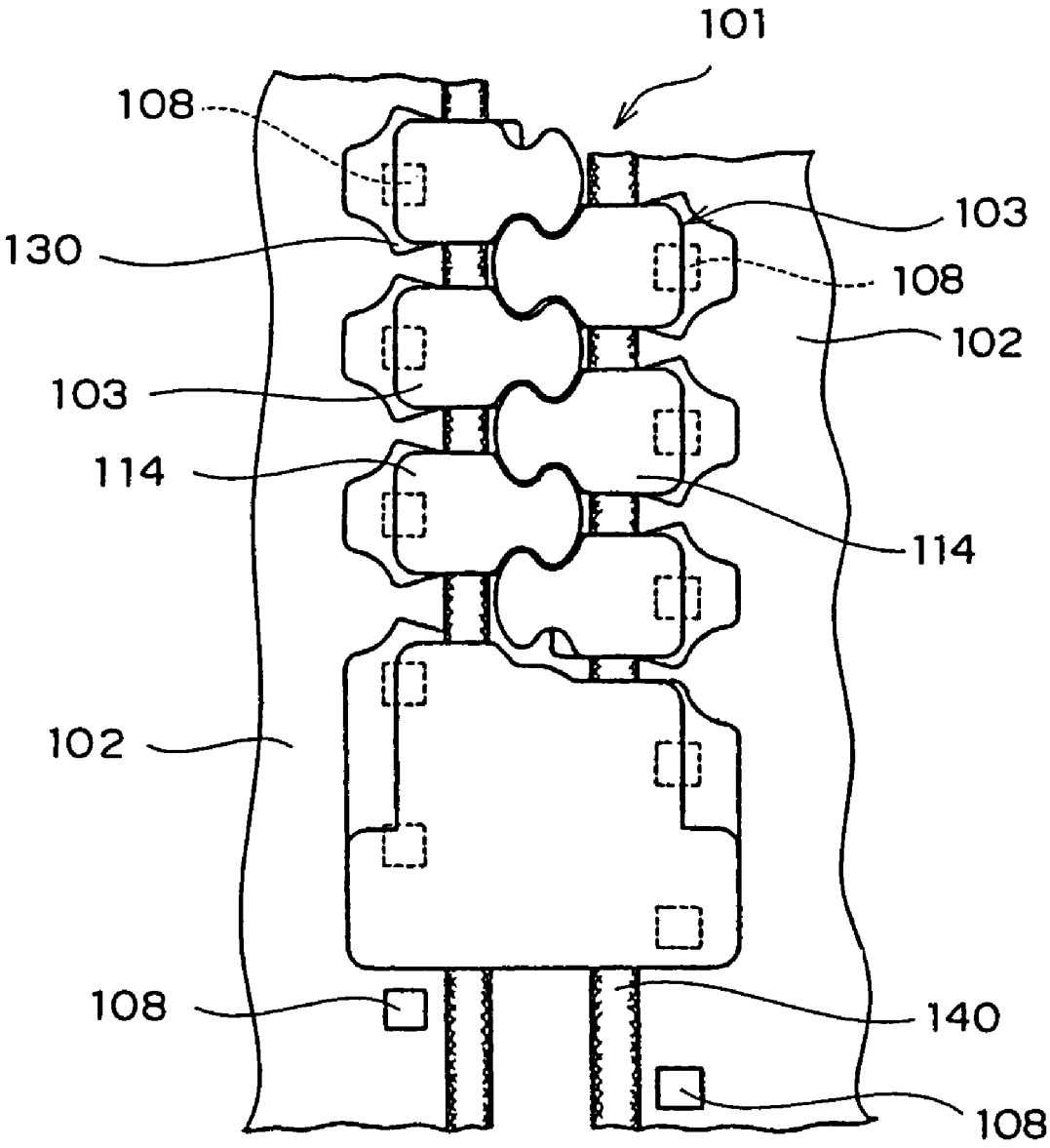
FIG. 15 PRIOR ART
FIG. 15 is a front view of a known slide fastener.
Figure 16:
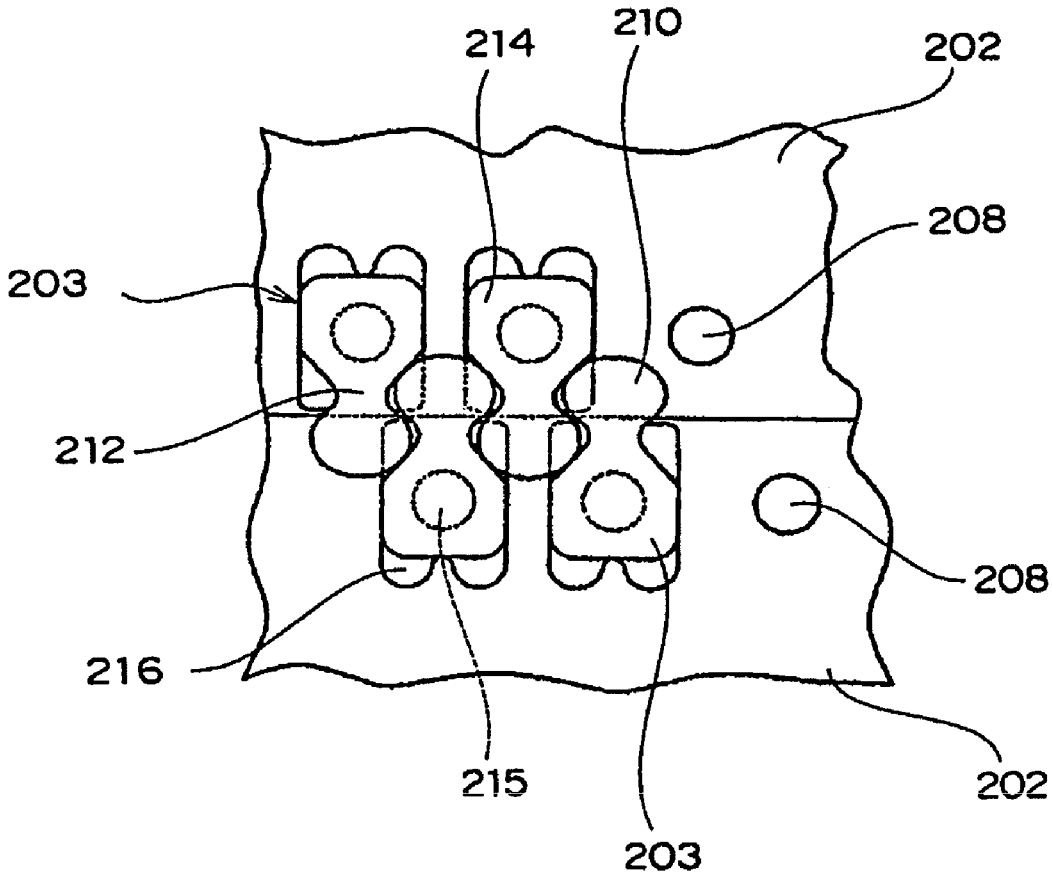
FIG. 16 PRIOR ART
FIG. 16 is a front view of a known waterproof slide fastener.

The configuration of the reinforcing portion 18 varies as shown in FIGS. 6 to 14. A reinforcing portion 18 shown in FIGS. 6 to 8 is formed in the same thickness as the engaging projection 13 formed at the neck portion 12 and the tongue piece 16 formed at the rear end of the leg portion 14 such that the reinforcing portion 18 projects more than the width of the engaging projection 13. A reinforcing portion 18 shown in FIGS. 9 to 11 is formed in the same thickness as the leg portion 14 such that the reinforcing portion 18 projects more than the width of the engaging projection 13. A lower portion of a reinforcing portion 18 shown in FIGS. 12 to 14 is formed in the same thickness as the engaging projection 13 and the tongue piece 16, and an upper portion thereof is formed into a slope 19 by tapering together with the leg portion 14. The respective reinforcing portions 18 prevent the through hole 8 from being exposed even if a load is applied to the fastener tape 2 in the fastener chain 1, thereby not damaging the water-tightness and airtightness.

First Embodiment

In a waterproof slide fastener of a first embodiment as shown in FIGS. 1 to 5, a fastener tape 2 has waterproof property, comprising a covering layer 6 formed by covering the entire front and rear surfaces of woven or knitted base fabric 5 with elastomer, for example, thermoplastic elastomer or synthetic rubber. Through holes 8 going through between the front and rear surfaces are provided in the side edge of the fastener tape 2, that is, at positions at which fastener elements 3 are to be attached. Then, the fastener elements 3 are attached by injection molding using thermoplastic resin, such as polyamide, polyacetal, polypropylene, or polybutylene terephthalate so as to cover the through holes 8. In the fastener element 3, a side of opposing fastener chains 1 is defined as a front end, and the opposite side thereof is defined as a rear end. Also, a width is the dimension of the fastener element 3 in the longitudinal direction of the fastener tape 2. Also, a thickness is the height of the fastener element 3 from the surface of the fastener tape 2.

Figure 2:
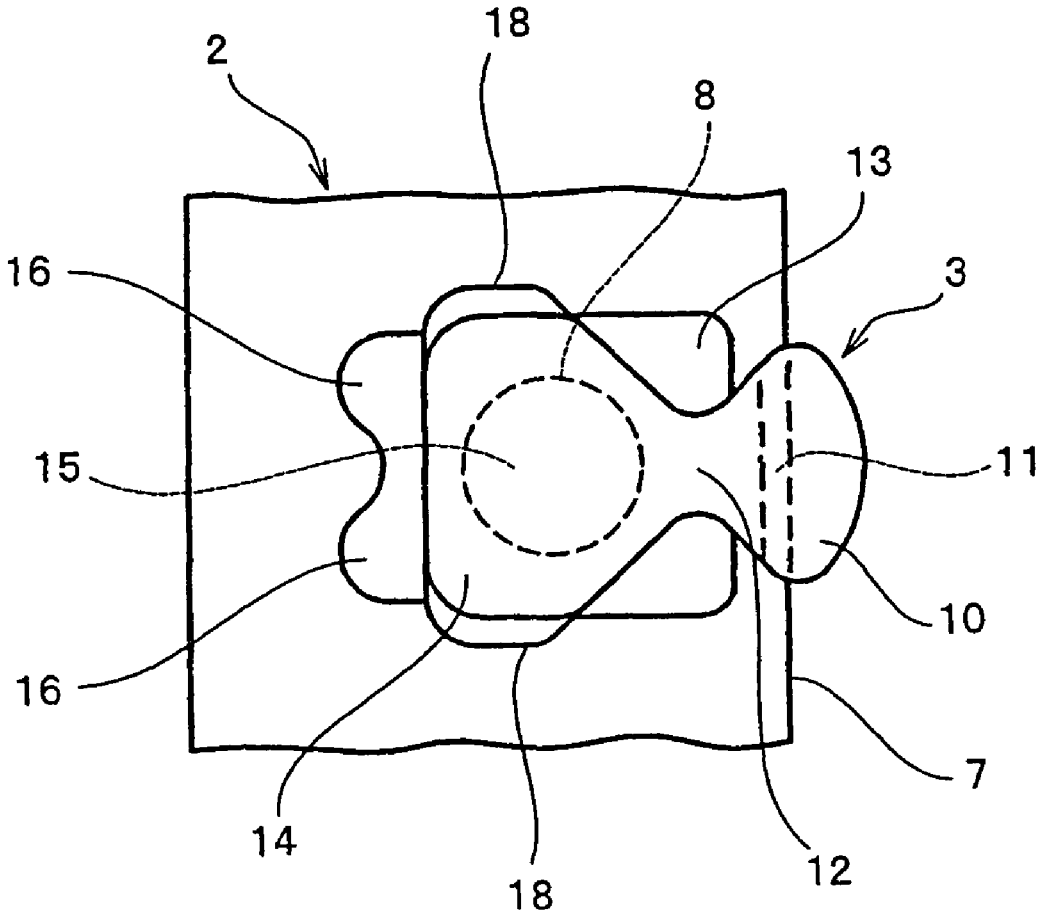
FIG. 2 is a front view of the fastener element of the waterproof slide fastener.
Figure 3:
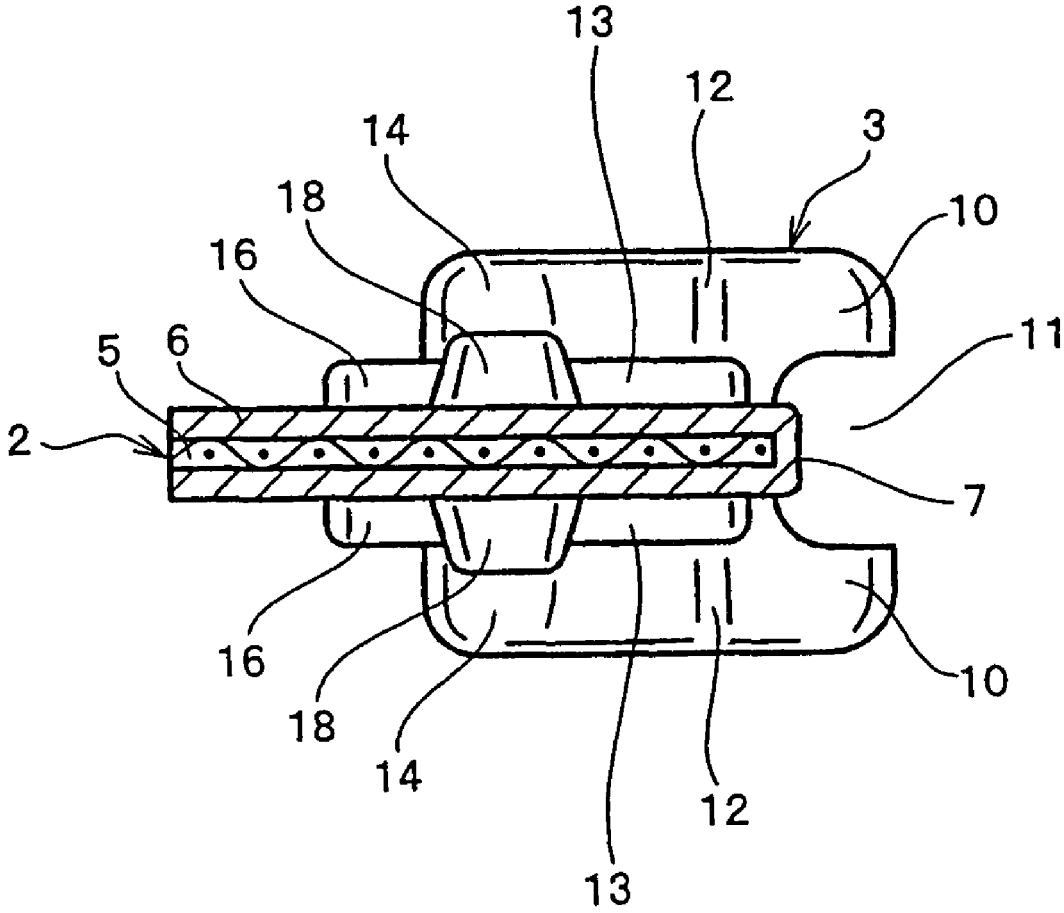
FIG. 3 is a side view of the fastener element of the waterproof slide fastener.
Figure 4:
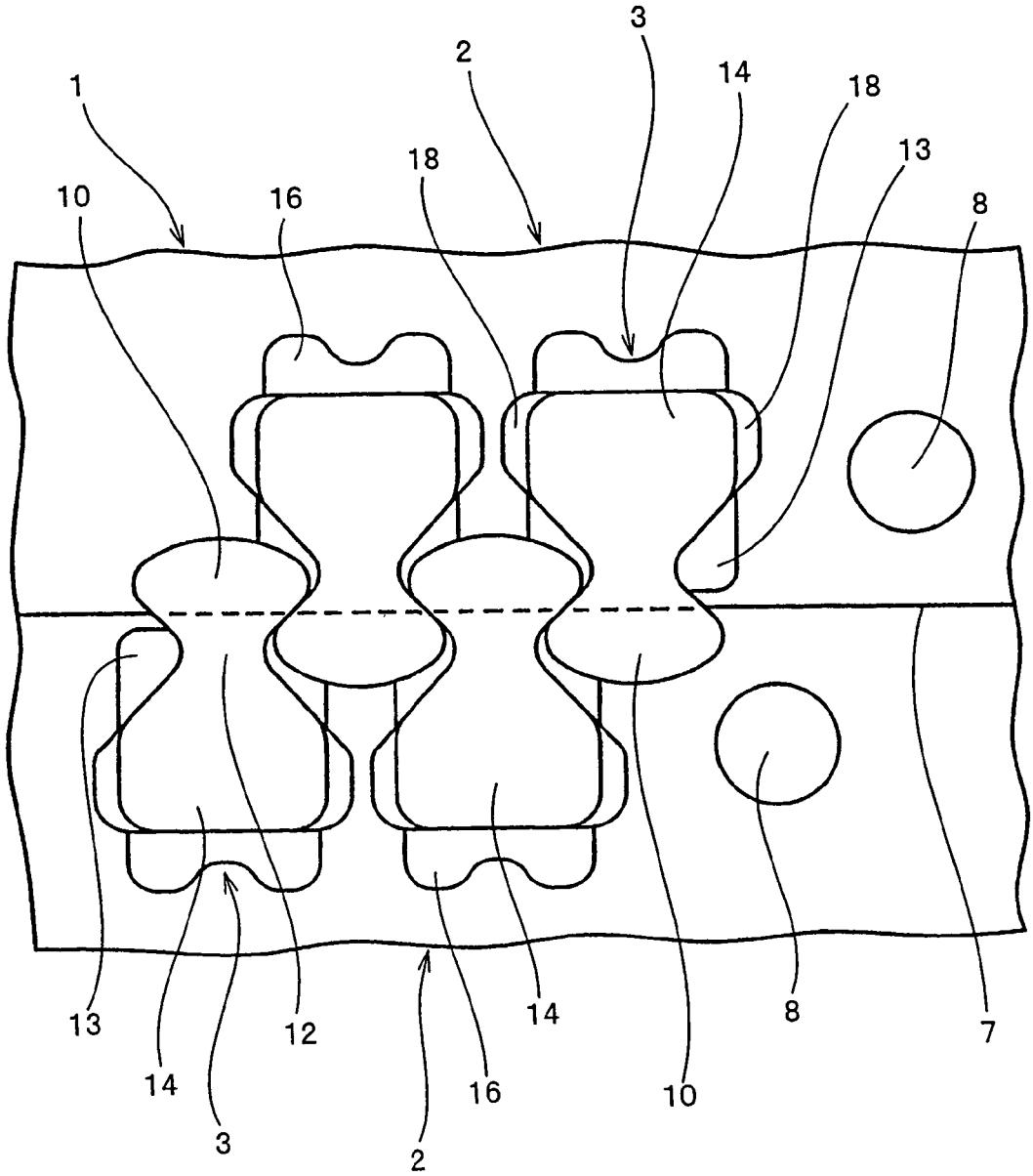
FIG. 4 is a front view of the fastener chain of the waterproof slide fastener.

In each fastener element 3, a coupling head 10 to engage an engaging projection 13 of a mating fastener element is provided by providing a coupling concave portion 11 having concave shape at its front end portion, and a neck portion 12 constricted inside is formed subsequent to the coupling head 10. Then, the flat engaging projection 13 which substantially coincides with the width of a leg portion 14 and is wider than the neck portion 12 is provided, the engaging projection 13 being capable of engaging with the coupling concave portion 11 of the mating fastener element. A tape edge portion 7 of the fastener tape 2 is formed to be exposed on the front face of the engaging projection 13, that is, on the side of the coupling head 10 as shown in FIGS. 1 to 3. When right and left fastener elements 3 couple each other, the tape edge portion 7 exposed from the engaging projection 13 is pressed to the inner face of the coupling concave portion 11, so that as shown in FIG. 4, the tape edge portions 7 butt against each other in a straight line so as to maintain water-tightness and airtightness at the tape edge portion 7 securely.

The leg portion 14 whose width substantially coincides with the width of the engaging projection 13 is provided subsequent to the neck portion 12 such that the leg portion 14 is wider than the neck portion 12 and the through hole 8, and the leg portion 14 is attached by molding so as to cover the through hole 8 provided in the fastener tape 2. The front and rear surfaces of the leg portion 14 are connected by a connecting portion 15 through the through hole 8, and a tongue piece 16 having the same thickness as the engaging projection 13 is provided at the rear end of the leg portion 14, so that flanges on both sides of a slider can make slide on the tongue piece 16. The tongue piece 16 is thin plate shaped and projects from the rear end side of the leg portion 14. The tongue piece 16 is dented in the center of the rear end of the leg portion 14, and the width of each of the two tongue pieces 16 is formed smaller than the width of the reinforcing portion 18, which is located back and forth of the leg portion 14 and projects from the sides of the leg portion 14. The reinforcing portion 18 is formed on the side of the leg portion 14, that is, on the side where it opposes adjacent fastener element 3.

The reinforcing portion 18 projecting from the sides of the leg portion 14, being thicker than the engaging projection 13 and thinner than the leg portion 14 is provided integrally with the leg portion 14 on the fastener element 3 attached to the fastener tape 2. The reinforcing portion 18 covers the longitudinal direction of the through hole 8 provided in the fastener tape 2 or the longitudinal direction of the fastener chain 1, at least part of the through hole 8, that is, a range in which the through hole 8 is formed, for example, so that the through hole 8 is surrounded by the reinforcing portion 18. Consequently, the through hole 8 formed in the fastener tape 2 is prevented from being exposed out of the fastener element 3 attached to the fastener tape 2, thereby preventing water-tightness and airtightness from being damaged even when a load is applied to the fastener tape 2 of the fastener chain 1.

Figure 5:
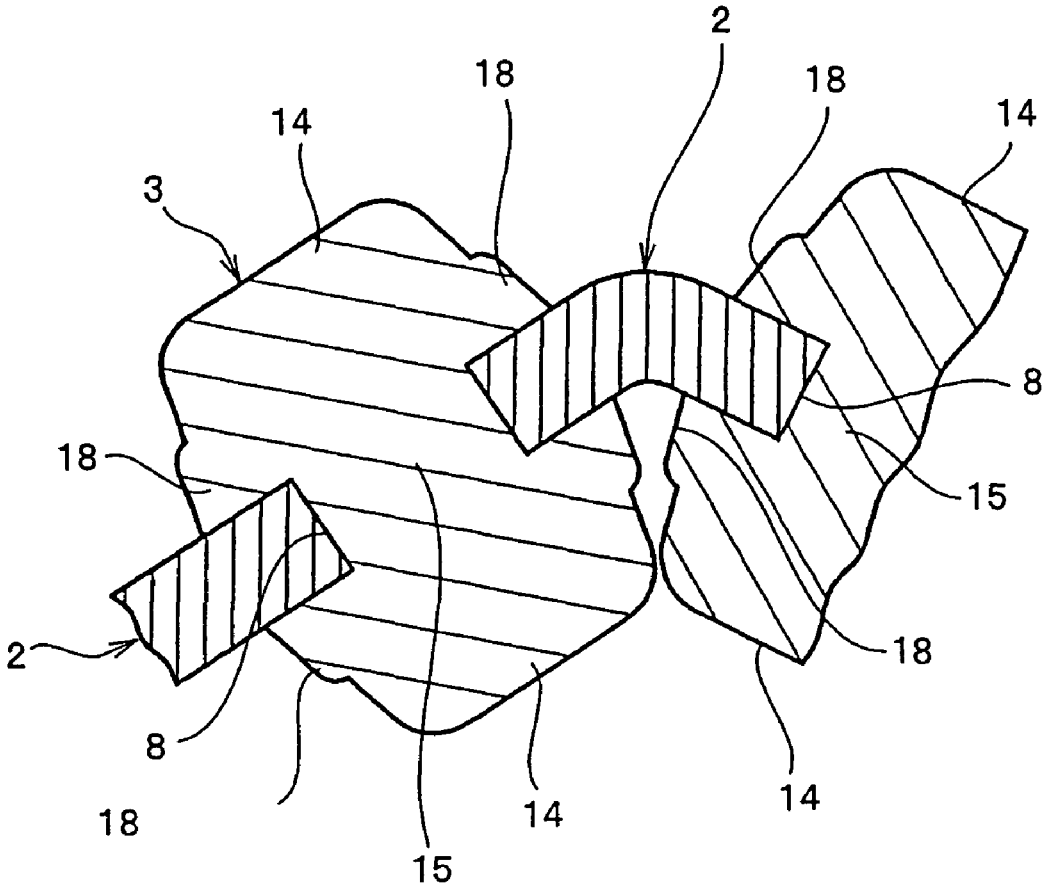
FIG. 5 is a sectional view of the fastener element when the waterproof slide fastener is bent.

The reinforcing portion 18 is formed in such a thickness that it does not make contact with the reinforcing portion 18 of adjoining fastener element 3 although the leg portions 14 of adjoining fastener elements 3 make contact with each other when the fastener tape 2 of the fastener chain 1 is bent as shown in FIG. 5. As a consequence, the reinforcing portions 18 never block bending of the fastener chain 1. Preferably, the reinforcing portions 18 are formed to the sides of the leg portion 14 and correspond to the through hole 8. Corresponding to the through hole 8 means covering a range extending from the side of the leg portion 14 in the range of the through hole 8 formed in the fastener tape 2 on an extended line extending to the side of the fastener element 3.

As for condition for providing the reinforcing portion 18 integrally with the leg portion 14, preferably, the following equation is established when the width of the reinforcing portion 18 provided on both sides of the leg portion 14 is W and the diameter of the through hole 8 is D in consideration of the attachment strength of the fastener element 3 to the fastener tape 2.

$$W/D=1.77 \text{ to } 2.13$$

This range is a condition for the through hole 8 provided on the fastener tape 2 not to be exposed out of the fastener tape 3. Further, because the width of the reinforcing portion 18 is larger than the width of the engaging projection 13, an interval between adjoining fastener elements 3 is larger at the engaging projection 13 than at the reinforcing portion 18.

Second Embodiment

In a waterproof slide fastener of a second embodiment shown in FIGS. 6 to 8, the configuration of a fastener tape 2 having waterproof property is the same as that of the first embodiment. Through holes 8 going through between the front and rear surfaces of the fastener tape 2 are provided, and then, a fastener element 3 for covering the through hole 8 is formed into the same configuration as the above-described embodiment. The fastener element 3 is formed by injection-molding a coupling head 10 having a coupling concave portion 11, a neck portion 12 having an engaging projection 13, and a leg portion 14 having a tongue piece 16 projectingly at the rear end on the through hole 8 by using the same thermoplastic resin as described previously, so that the front and rear surfaces are connected by a connecting portion 15.

In this fastener element 3, the reinforcing portion 18 having the same thickness as the engaging projection 13 and the tongue piece 16 provided at the rear end is formed on both sides of the leg portion 14 in the longitudinal direction of the fastener chain 1 such that the reinforcing portion 18 is integrally molded with the leg portion 14 facing the through hole 8. As a consequence, the surrounding of the leg portion 14 is attached equally and firmly to the fastener tape 2, thereby securing water-tightness and airtightness.

Third Embodiment

In a waterproof slide fastener of a third embodiment shown in FIGS. 9 to 11, the configuration of a fastener tape 2 having waterproof property is the same as that of the first embodiment. Through holes 8 going through between the front and rear surfaces of the fastener tape 2 are provided along the side edge of the fastener tape 2, and then, a fastener element 3 for covering the through hole 8 is formed into the same configuration as the above-described embodiment. The fastener element 3 is formed by injection-molding a coupling head 10 having a coupling concave portion 11, a neck portion 12 having an engaging projection 13, and a leg portion 14 having a tongue piece 16 projectingly at the rear end on the through hole 8 by using the same thermoplastic resin as described previously, so that the front and rear surfaces are connected by a connecting portion 15.

The through hole 8 provided in the fastener tape 2 is covered with the leg portion 14 of the fastener element 3, and the reinforcing portions 18 having the same thickness as the leg portion 14 are formed on both sides of the leg portion 14 facing the through hole 8 such that they project to the side more than the engaging projections 13. As a consequence, the through hole 8 can be blocked from being exposed out of the fastener element 3 even if the size of the fastener element 3 is small, and water-tightness and airtightness can be maintained.

Fourth Embodiment

In a waterproof slide fastener of a forth embodiment shown in FIGS. 12 to 14, the configuration of a fastener tape 2 having waterproof property is the same as that of the first embodiment. Through holes 8 going through between the front and rear surfaces of the fastener tape 2 are provided along the side edge of the fastener tape 2, and then, a fastener element 3 for covering the through hole 8 is formed into the same configuration as the above-described embodiment. The fastener element 3 is formed by injection-molding a coupling head 10 having a coupling concave portion 11, a neck portion 12 having an engaging projection 13, and a leg portion 14 having a tongue piece 16 projectingly at the rear end on the through hole 8 by using the same thermoplastic resin as described previously, so that the front and rear surfaces of the fastener elements 3 are connected by a connecting portion 15.

The through hole 8 provided in the fastener tape 2 is covered with the leg portion 14 of the fastener element 3, and the reinforcing portion 18 is provided integrally with the leg portion 14 on both sides of the leg portions 14 facing the through hole 8 by forming a lower portion thereof into the same thickness as the engaging projection 13 and the tongue piece 16 and forming an upper portion thereof into a slope 19 by tapering it with the leg portion 14. Consequently, the appearance of the fastener element 3 is formed in an excellent shape and design while water-tightness and airtightness can be maintained.

As for the waterproof slide fastener of the present invention, its large size waterproof slide fastener can be used in products supplied with a large load such as tent or oil fence and the like, and its small size waterproof slide fastener can be used in waterproof clothing, shoes and packaging products.

What is claimed is:

1. A waterproof slide fastener, wherein an entire surface of a fastener tape is covered with elastomer; through holes are made in the fastener tape;

wherein the fastener elements consists of a coupling head having a coupling concave portion provided at a front end of the fastener element, a constricted neck portion, and a wide engaging projection projecting at the neck portion, a wide leg portion, and a tongue piece projecting from a rear end of the leg portion;

wherein the fastener elements are integrally molded on front and rear surfaces of the fastener tape using thermoplastic resin; a tape edge portion is exposed on a foreside of the engaging projection; and when the fastener elements are coupling, the tape edge portions are pressed against each other;

wherein the leg portions are attached to the through holes, and covering the through holes; and the fastener element further comprising reinforcing portions, extending in the longitudinal direction of the fastener tape, having a wider width than the width of the longitudinal direction of the fastener tape of the engaging projection, integrally formed therewith, wherein the reinforcing portions are formed thicker than the engaging projections and thinner than the leg portions in a direction substantially parallel with an axial direction the through holes extend through the fastener tape.

2. The waterproof slide fastener according to claim 1, wherein the reinforcing portions projecting from the sides of the leg portion are formed so as to cover at least a part of each of the through holes made in the fastener tape in the longitudinal direction of the fastener tape.

* * * * *